US006227900B1

(12) United States Patent
Heise

(10) Patent No.: US 6,227,900 B1
(45) Date of Patent: May 8, 2001

(54) CONNECTOR FOR PROVIDING A HUMIDITY-TIGHT ELECTRICAL CONNECTION

(75) Inventor: Andreas Heise, Mörfelden (DE)

(73) Assignee: Continental Teves AG & Co. OHG, Frankfurt (DE)

( * ) Notice: Subject to any disclaimer, the term of this patent is extended or adjusted under 35 U.S.C. 154(b) by 0 days.

(21) Appl. No.: 09/254,606

(22) PCT Filed: Jul. 5, 1997

(86) PCT No.: PCT/EP97/03557

§ 371 Date: May 14, 1999

§ 102(e) Date: May 14, 1999

(87) PCT Pub. No.: WO98/10489

PCT Pub. Date: Mar. 12, 1998

(30) Foreign Application Priority Data

Sep. 6, 1996 (DE) ..... 196 36 119

(51) Int. Cl.[7] ..... H01R 4/26
(52) U.S. Cl. ..... 439/426; 439/276
(58) Field of Search ..... 439/426, 201, 439/521, 271, 272

(56) References Cited

U.S. PATENT DOCUMENTS

| | | | | |
|---|---|---|---|---|
| 3,127,230 | | 3/1964 | Marquis | 339/118 |
| 3,158,420 | | 11/1964 | Olson | 339/96 |
| 3,522,576 | * | 8/1970 | Cairns | 339/91 |
| 3,571,779 | | 3/1971 | Collier | 339/18 |
| 3,972,581 | * | 8/1976 | Oldham | 339/96 |
| 4,085,993 | * | 4/1978 | Cairns | 339/94 |
| 4,187,388 | * | 2/1980 | Roberts | 174/68.5 |
| 4,425,017 | * | 1/1984 | Chan | 339/96 |
| 4,662,692 | * | 5/1987 | Uken et al. | 339/96 |
| 4,796,159 | * | 1/1989 | Mikshe | 361/429 |
| 5,007,861 | | 4/1991 | Stirling | 439/578 |
| 5,596,176 | | 1/1997 | Everitt | 174/151 |

FOREIGN PATENT DOCUMENTS

| | | |
|---|---|---|
| 2 259 673 | 6/1973 | (DE) . |
| 28 44 787 | 5/1979 | (DE) . |
| 43 10 157 | 10/1993 | (DE) . |
| 1 537 062 | 12/1978 | (GB) . |

OTHER PUBLICATIONS

Search Report of the German Patent Office for German Application 196 36 119.2.

* cited by examiner

*Primary Examiner*—Gary F. Paumen
(74) *Attorney, Agent, or Firm*—Rader, Fishman & Grauer PLLC

(57) ABSTRACT

A plug connector to produce a moisture-proof electrical coupling between a massive connecting wire and an electrical contact or contact element is generally composed of a receiving and guiding bush which has an inside diameter that is conformed to the outside diameter of the connecting wire and ends into an extension, and of a retaining element into which the wire tip is slipped when the wire is passed through the bush and through a pierceable foil. A permanently elastic sticky sealing compound is filled into the extension on the exit side of the bush.

In a variation, the receiving and guiding bush is closed on the exit side by a pierceable diaphragm.

14 Claims, 2 Drawing Sheets

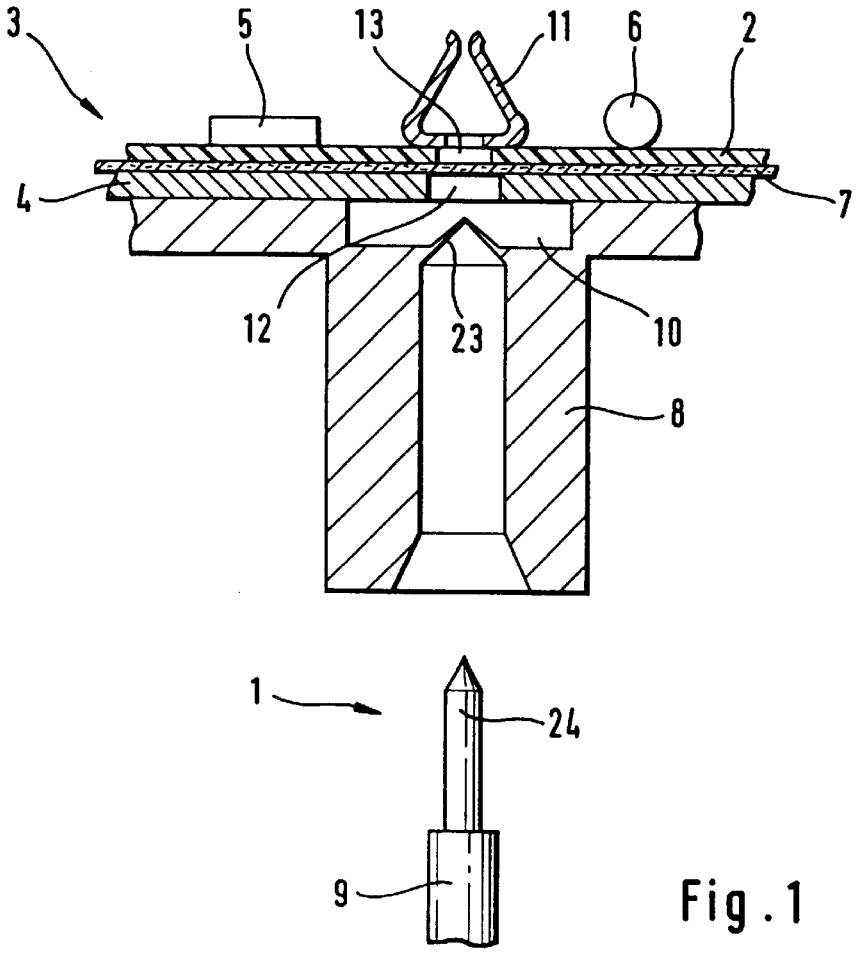
Fig. 1
Fig. 3
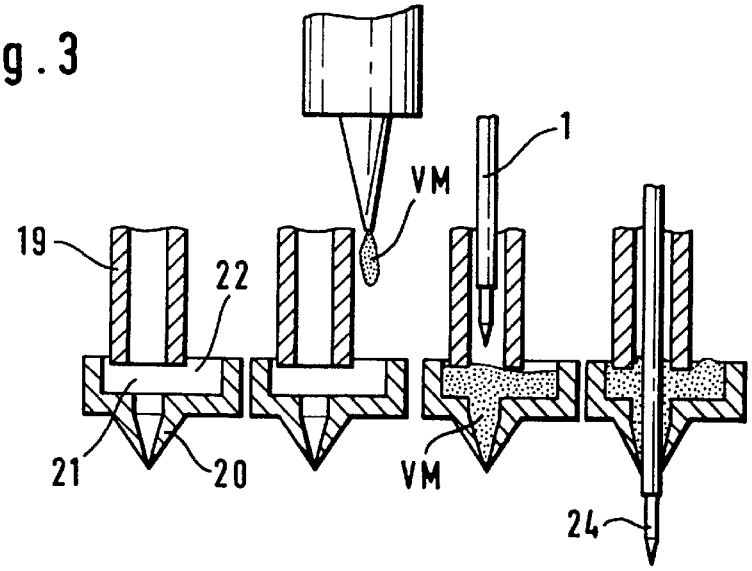

CONNECTOR FOR PROVIDING A HUMIDITY-TIGHT ELECTRICAL CONNECTION

The present invention generally relates to electrical connectors and more particularly relates to a plug connector to produce a moisture-proof electrical coupling between a massive connecting wire and an electrical contact or contact element.

BACKGROUND OF THE INVENTION

Many different applications are possible for plug connectors of this type. One application, which is in the center of interest in the present example, is the assembly and installation of electrically operated components and structural groups, electric circuits, printed circuit boards, or like elements, in automotive vehicle electronics. This field especially focuses on reliability, mechanical and electrical loading capacity, on the one hand, and favorable manufacturing and assembling costs, on the other hand. Another requirement in vehicles and vehicle components involves extensive protection against, or insensitivity to, humidity and contaminants.

Generally, the electrically operated or electrically connected components in an automotive vehicle are connected by way of cables and plug connectors, i.e., plugs and receiving bushes, and like elements. Frequently, costly manufacturing and assembling techniques are used to achieve sufficient sealing against moisture and contaminants, which is of critical importance for the reliability and long service life of the systems. In addition, it is required in the majority of cases that detachment and reestablishment of the connection for maintenance, error detection purposes and similar operations be possible at least several times.

An object of the present invention is to provide a plug connector which is appropriate for such applications, which can be detached and recoupled at least several times, which withstands moisture and contaminants, and which is reliable and adapted to be stressed mechanically and electrically. Another objective of the plug connector is to minimize efforts in manufacture and assembly.

The connector of the present invention has a receiving and guiding bush which accommodates the connecting wire and ends into an extension provided for being filled with a permanently elastic sticky sealing compound and used as a reservoir for the sealing compound, and includes a retaining element into which the wire tip, when inserted into the bush, penetrates through a previously closed foil or a thin wall of any acceptable material.

In this way, a small number of simple and inexpensive components may be used to configure the plug connector, permitting quick asssembly and effective sealing of the point of transition in relation to humidity and contaminants. When the connecting wire is detached and withdrawn from the bush, the point of transition, or the site where the wire passes through, is closed and sealed by the permanently elastic sticky sealing compound. Thus, the point of connection remains sealed until the connecting wire is plugged in again.

In a favorable embodiment of the present invention, the retaining element has the shape of a plug clamp, a soldering bush, or a like element which establishes the electrical contact between connecting wire and the contact element. An appropriate plug clamp of this type is described in the patent application No. 196 15 706.4 (P 8683) which is not yet published.

The connecting wire is preferably insulated, i.e., with an insulating casing which encompasses the metal wire, and extends through the correspondingly dimensioned bush, the extension and the pierceable foil up to the retaining element in which the insulated tip of the wire is inserted. At the transition to the extension, the bush may be provided with a 'stripping funnel' or a like device.

The plug connector according to the present invention is especially appropriate for connecting a device to a printed circuit board which is mounted on a flat-surface cooling element (generally an aluminum or copper plate), such that the bush is seated on the side of the cooling element and the retaining element on the side of the printed circuit board, and wherein the connecting wire is passed through corresponding apertures in the cooling plate and in the printed circuit board.

Further, the bush may terminate in an extension that is configured as a recess on the exit side of the bush and is filled with the sealing compound through a separate feed opening or a feed channel. However, it is also possible to pour in the sealing compound through the bush into the extension.

It is possible in all of the previous embodiments that upon insertion of the connecting wire into the bush or into the plug connector, the sealing compound which is thereby displaced is taken up by the extension used as a reservoir. When the wire is withdrawn from the bush, at least part of the sealing compound is again drawn into the opening that is released, and closes the orifice.

In a variation of the plug connector of the present invention which is advantageous or deemed at least sufficient in many cases, the receiving and guiding bush is closed by a pierceable diaphragm on the exit side of the plugged-in connecting wire. When the highly fluid sealing compound is poured in, this compound will collect in the area of the diaphragm and in the adjacent extension. When the connecting wire is inserted and punctures the diaphragm, the elastic sealing compound will seal the orifice area.

Further details and advantages of the plug connector of the present invention can be taken from the following description of embodiments making reference to the accompanying drawings.

BRIEF DESCRIPTION OF THE DRAWINGS

FIG. 1 is a longitudinal cross-sectional and schematically simplified view of components of a plug connector of the type of the present invention and arrangement thereof on the cooling element and the bottom plate of the printed circuit board of an electronic controller.

FIG. 3 is a schematic view of the design and the filling of a receiving and guiding bush for a design variation of the present invention.

DETAILED DESCRIPTION OF THE PREFERRED EMBODIMENTS

Figure 2:
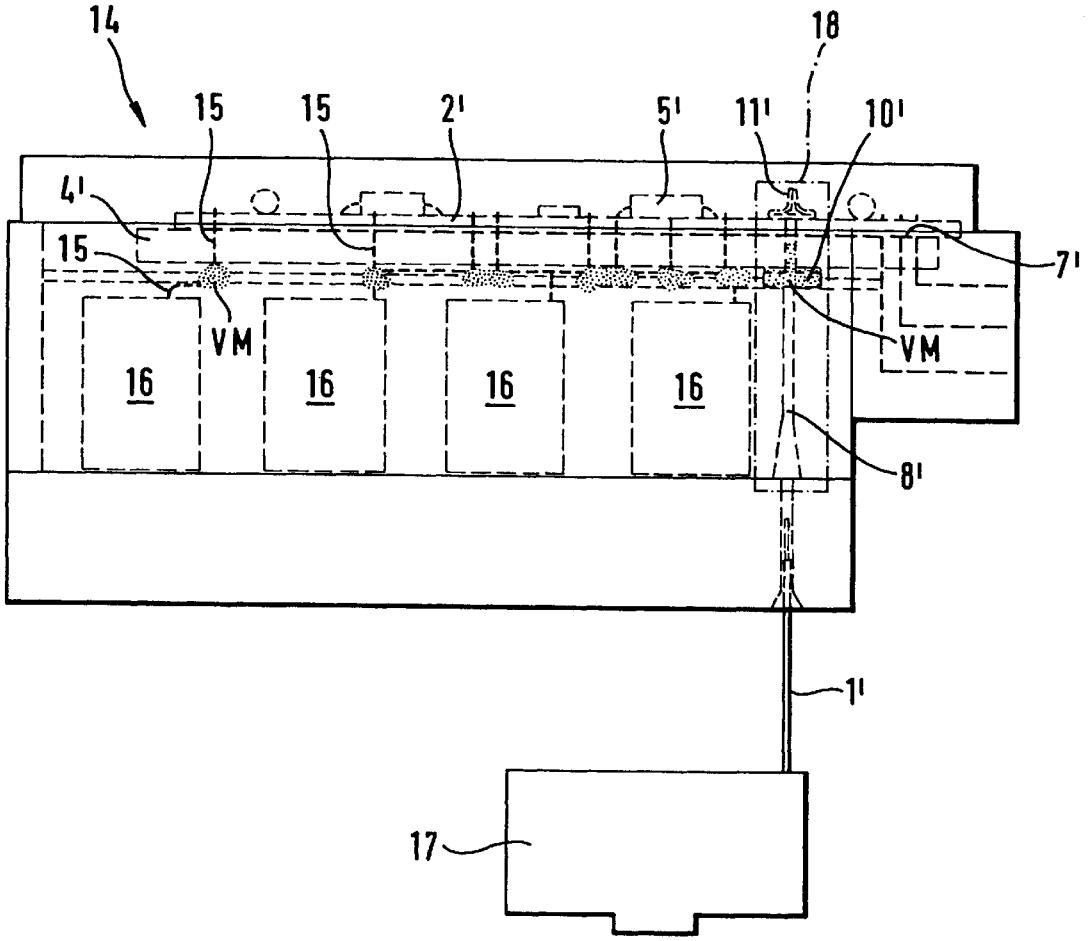
FIG. 2 is a schematic view of a controller or a complete unit using the plug connector according to FIG. 1.

FIG. 1 shows the most important components of a plug connector of the present invention before the insertion of a connecting wire 1. Wire 1 in the FIG. 1 embodiment is used for contacting, or for establishing an electrically conductive connection between a devia (not shown) to which the connecting wire 1 is fitted in a conventional manner (or by another plug connector of the type of the present invention) and the components or conductor paths on a bottom plate 2 which is part of a printed circuit board 3 of an electronic controller. The entire printed circuit board, which is shown in cross-section in FIG. 1, includes a flat-surface cooling element 4, (for) example, an aluminum plate,) and the bottom plate 2 on which electrical, symbolically represented construction elements 5, 6 (transistors, capacitors, etc.) are mounted, and conductor paths (not shown). The bottom plate 2 and cooling element 4 are interconnected by a thin adhesive foil 7 which has several layers, if necessary.

The connecting wire 1 is slipped into a receiving and guiding bush 8 of the plug connector of the present invention during an assembling or manufacturing process. The wire 1 provided with an insulating casing 9 is passed through the bush 8, extends through a free space or an extension 10 and through the adhesive foil 7, which is pierced by the wire 1, into a retaining element 11 which is herein configured as a represented plug clamp. Plug clamp 11 receives only the uninsulated front part, i.e., tip 24 of the connecting wire 1. Openings 12, 13 are provided in the cooling element 4 that correspond to openings in the bottom plate 2. The connecting wire 1 extends through the openings into the plug clamp 11.

In the embodiment of the present invention according to FIG. 1, at the transition from the bush 8 to the extension 10, there is a constriction 23 in the shape of an elastic lip or a corresponding diaphragm part which, for example, provides a 'stripping funnel' or the like and thereby promotes closing and sealing the orifice after the plug connector has been detached.

The free space or the extension 10 which is provided for being filled with a permanently elastic sticky sealing compound is particularly important for the function of the plug connector according to the present invention. Such sealing compounds, for example, bearing the product name SILGEL (Sil Gel 611 of Messrs. Wacker Chemie Burghausen), are known in the art and are used e.g. for sealing copper wire ducts through printed circuit boards (see FIG. 2).

The inside diameter of bush 8 is conformed to the outside diameter of wire 1. When the wire 1 is slipped through the extension 10 filled with SILGEL or the sealing compound, part of the compound is displaced through an opening (not shown in FIG. 1) or into a channel (22, in FIG. 3) through which the compound has been filled in before. The remaining sticky compound fills the interstices between the slipped-in connecting wire and the openings in the cooling element and in the printed circuit board, with the result of achieving a high-quality, permanent seal and, thus, protecting against moisture and the ingress of contaminants.

The plug connector, i.e., the connection between the connecting wire 1 and the other components of the plug connector, is detachable. When the connecting wire 1 is withdrawn, the permanently elastic sticky sealing compound VM which is disposed in the extension 10 will shut off the orifice through which the wire 1 extended. Therefore, the connection to the printed circuit board 3 remains sealed even after removal of the connecting wire 1. This is important, for example, in order to prevent moisture from propagating through the openings 12, 13 to the side of the bottom plate 2 on which components are fitted.

FIG. 2 shows application of the plug connector of the present invention. This application concerns a controller 14 for an anti-lock vehicle brake system. The controller accommodates in a closed housing a printed circuit board composed of a carrier plate or cooling element 4' and a bottom plate 2', and equipped with electronic components 5', which are connected to a great number of valve coils by way of connecting wires shown in dotted lines or by connecting wires 15 shown in broken lines. The orifices of the wires 15 through the cooling element 4' are moisture proof, and are enclosed by a permanently elastic sticky sealing compound VM with which the extension 10' of the plug connector of the present invention is also filled.

A hydraulic pump 17 is connected electrically to the controller 14 in the embodiment of FIG. 2. To this end, pump 17 is equipped with massive connecting wires (only one connecting wire 1' is shown). Pump 17 is mounted onto the housing, and the connecting wire 1' is inserted through the receiving and guiding bush 8'. Portion 18, shown in dotted boundary lines in FIG. 2, comprises the plug connector shown in an enlarged view in FIG. 1 and explained hereinabove. Sealing compounds, such as SILGEL, are filled in a highly fluid state into the area being sealed, in particular into the opening or extension 10, 10' at the end where the wire 1, 1' exits from the bush 8, 8'.

FIG. 3 shows a schematic representation of an embodiment of the present invention wherein the connecting wire 1 which is inserted through a receiving and guiding bush 19 is sealed by the permanently elastic sealing compound VM in the exit area of the bush 19. Bush 19 is used to this effect and is closed by a pierceable diaphragm 20 at the exit side 20 of the bush 19 before the connecting wire 1 is slipped in. Proximate the exit side, in turn there is provided an extension 21 configured as an open feed channel 22, or a like device, into which the initially thinly fluid sealing compound VM (as is represented in FIG. 3) is filled during assembly of the controller. This compound VM is collected in the extension 21 which takes up the permanently elastic sticky compound VM when the wire 1 is inserted. Shown in FIG. 3, from the left to the right, are the empty bush 19, pouring in of the sealing compound, introduction of the connecting wire 1 and puncturing the pierceable diaphragm 20 (right-hand illustration). The tip 12 of the wire 1 may then be connected again to the printed circuit board by way of a plug clamp, soldering bush or a similar element. Sealing of the slipped-in connecting wire by way of the sealing compound VM is already effected in the bush 19.

What is claimed is:

1. A plug connector for producing a moisture-proof electrical coupling between a massive connecting wire and an electrical contact or contact element, comprising:

a receiving and guiding bush which accommodates a connecting wire and terminates into an extension provided as a reservoir filled with an elastic, sticky sealing compound;

a retaining element external to the reservoir; and a foil or a thin wall of any other type which is closed in the beginning and is adapted to be pierced, wherein the tip of the connecting wire penetrates through the reservoir and through the foil or thin wall when inserted into the bush.

2. The plug connector as claimed in claim 1, wherein the retaining element has the shape of a plug clamp, or a soldering bush which establishes the electrical contact between the connecting wire and the contact element.

3. The plug connector as claimed in claim 1, wherein the connecting wire is provided with an insulating casing and extends through the bush, the extension and the pierceable foil up to the retaining element.

4. The plug connector as claimed in claim 1, further including at least one of a stripping diaphragm or a stripping funnel is provided at the exit area or at the transition from the bush to the extension.

5. The plug connector as claimed in claim 1, wherein the connector is used for connecting a consumer to a printed circuit board which is mounted on a flat-surface cooling element, wherein the bush is seated on the side of the cooling element and the retaining element on the side of the printed circuit board, and wherein the connecting wire is passed through openings in the cooling element and in the printed circuit board.

6. The plug connector as claimed in claim 1, wherein the extension in which the bush ends is configured as a recess on the exit side of the bush and is filled with the sealing compound through a feed opening or a feed channel.

7. The plug connector as claimed in claim 1, wherein the extension in which the bush ends is filled with the sealing compound through the bush.

8. A plug connector to produce a moisture-proof electrical coupling between a massive connecting wire and an electrical contact or contact element, comprising:

a receiving and guiding bush which accommodates the connecting wire and includes an extension on an exit side of the receiving and guiding bush that is provided as a reservoir filled with an elastic sticky sealing compound;

and a pierceable diaphragm such that the connecting wire pierces the diaphragm as it exits the reservoir.

9. The plug connector as claimed in claim 8, wherein the extension includes a feed opening for the sealing compound or is connected to a feed channel.

10. The plug connector as claimed in claim 8, further including multiple receiving and guiding bushes, each bush including an extension on the exit side of the introduced connecting wire, wherein the extension is provided as a reservoir for the permanently elastic sticky sealing compound.

11. The plug connector as claimed in claim 10, wherein each extension includes a feed opening for the sealing compound or is connected to a feed channel.

12. The plug connector as claimed in claim 11, wherein the extensions or feed openings or feed channels are all interconnected for simultaneously filling a number of extensions.

13. A plug connector for producing a moisture-proof electrical coupling between a massive connecting wire and an electrical contact or contact element, comprising:

a receiving and guiding bush which accommodates insertion of the connecting wire, said bush projecting outside the contact element to provide locating indicia thereto, said bush including an extension on the exit side thereof that is provided as a reservoir filled with an elastic sticky sealing compound; and a pierceable diaphragm that acts as a floor of said extension for providing an exit to the inserted wire.

14. The plug connector as claimed in claim 13, wherein said bush includes a chamfered insertion opening for receiving the connecting wire.

* * * * *